US006540535B1

(12) United States Patent
Zhu et al.

(10) Patent No.: US 6,540,535 B1
(45) Date of Patent: Apr. 1, 2003

(54) SOCKET CONNECTOR HAVING RESILIENT ELEMENT FOR INCREASING CONTACT FORCE TO INSERTED PLUG

(75) Inventors: ZiQiang Zhu, Kunsan (CN); Lun Song Hu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/002,890

(22) Filed: Dec. 5, 2001

(30) Foreign Application Priority Data

Nov. 9, 2001 (CN) ..... 090219304

(51) Int. Cl.[7] ..... H01R 29/00; H01A 33/30

(52) U.S. Cl. ..... 439/188; 439/593; 439/607; 200/51.09

(58) Field of Search ..... 439/188, 592, 439/593, 839, 607, 608; 200/51.09, 51.1, 307

(56) References Cited

U.S. PATENT DOCUMENTS 4,393,283 A * 7/1983 Masuda ..... 200/51.09
6,190,205 B1 * 2/2001 Wu ..... 439/607
6,227,904 B1 * 5/2001 Wang et al. ..... 439/541.5
6,273,761 B1 * 8/2001 Hsu et al. ..... 439/676
6,319,065 B1 * 11/2001 Farnworth et al. ..... 439/632

* cited by examiner

*Primary Examiner*—Hien Vu
(74) *Attorney, Agent, or Firm*—Wei Te Chung

(57) ABSTRACT

A socket connector (1) includes an insulating housing (10), a shell (20) assembled to the housing, a plurality of terminals (30, 31), a plurality of resilient contacts (41, 42), a slide (50) and a resilient element (60). The slide contacts with selected different terminals when it is drawn by one of the resilient contacts. The resilient element is positioned between a side wall of the housing and at least one of the resilient contact for increasing the contact force of the resilient contact on an inserted audio plug.

5 Claims, 3 Drawing Sheets

SOCKET CONNECTOR HAVING RESILIENT ELEMENT FOR INCREASING CONTACT FORCE TO INSERTED PLUG

BACKGROUND OF THE INVENTION

1. Field of the Invention

The present invention relates to a socket connector, and particularly to a socket connector for insertion of an audio plug.

2. Description of the Related Art

U.S. Pat. No. 4,393,283 discloses a socket connector including two rows of terminals, a resilient contact and a slide secured at a free end of the resilient contact. When an audio plug is inserted into the socket connector, the resilient contact is pushed outward to move the slide thereby electrically switching some selected terminals. When the plug is withdrawn, the resilient contact returns to its original position. It is noted that above-mentioned performance requires that the resilient contact has excellent resiliency. However, this results in the resilient contact being difficult to provide sufficient contact force on the plug. In addition, the resilient contact is apt to be permanently deformed after frequent insertion and withdrawal of the plug.

SUMMARY OF THE INVENTION

Accordingly, the object of the present invention is to provide a socket connector for insertion of an audio plug wherein the connector has a resilient element for increasing contact force on the plug.

In order to achieve the object set forth, a socket connector of the present invention comprises an insulating housing, a plurality of terminals and a resilient contact respectively received within the housing, a slide arranged at a free end of the resilient contact, and a resilient element disposed between a wall of the housing and the resilient contact. When an audio plug is inserted into the socket connector, the resilient contact is pushed toward the side wall of the housing to drive the slide to move in the housing, thereby switching electrical connection between some selected terminals. It is noted that the resilient element is compressed during the insertion of the plug so as to stop the further movement of the resilient contact thereby providing the resilient contact to have sufficient contact force to the plug at all times. After the plug is withdrawn from the socket connector, the resilient element return to its original state and urges the resilient contact to return its original position.

Other objects, advantages and novel features of the invention will become more apparent from the following detailed description of the preferred embodiment when taken in conjunction with the accompanying drawings.

DETAILED DESCRIPTION OF THE INVENTION

Figure 1:
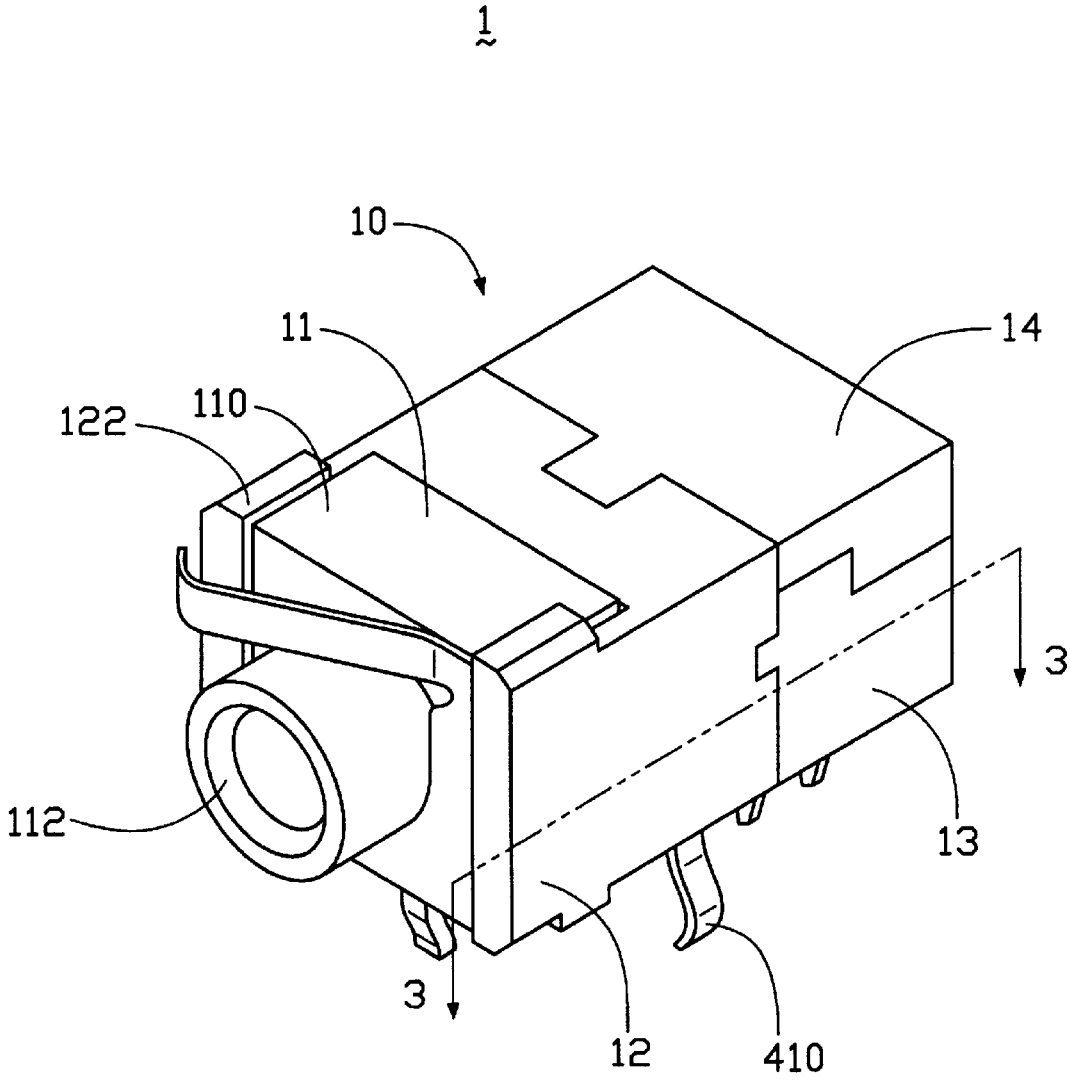
FIG. 1 is an assembled view of the socket connector of the present invention.

Reference will now be made to the drawing figures to describe the present invention in detail.

Figure 2:
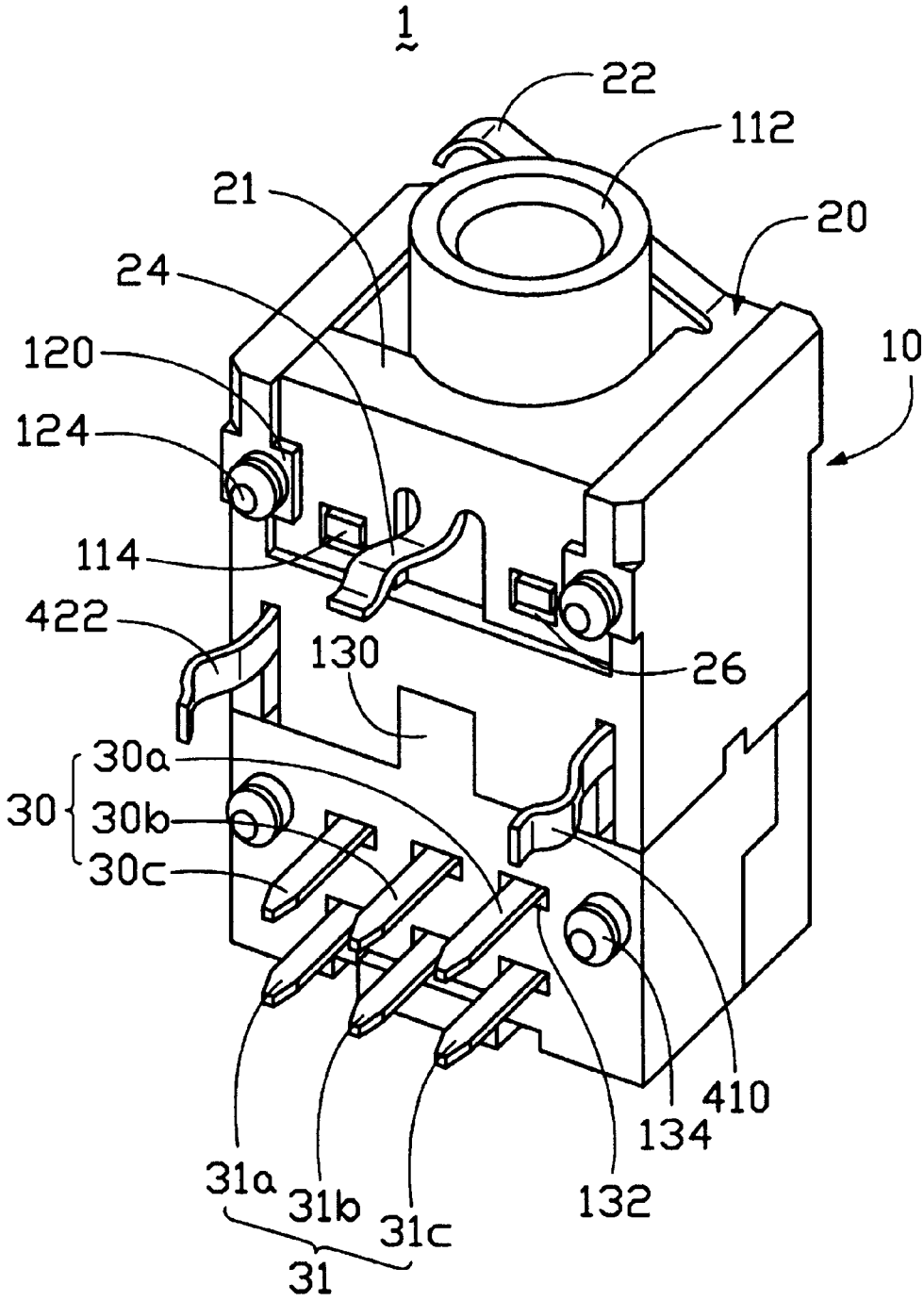
FIG. 2 is an assembled view of the socket connector of the present invention from another perspective.
Figure 3:
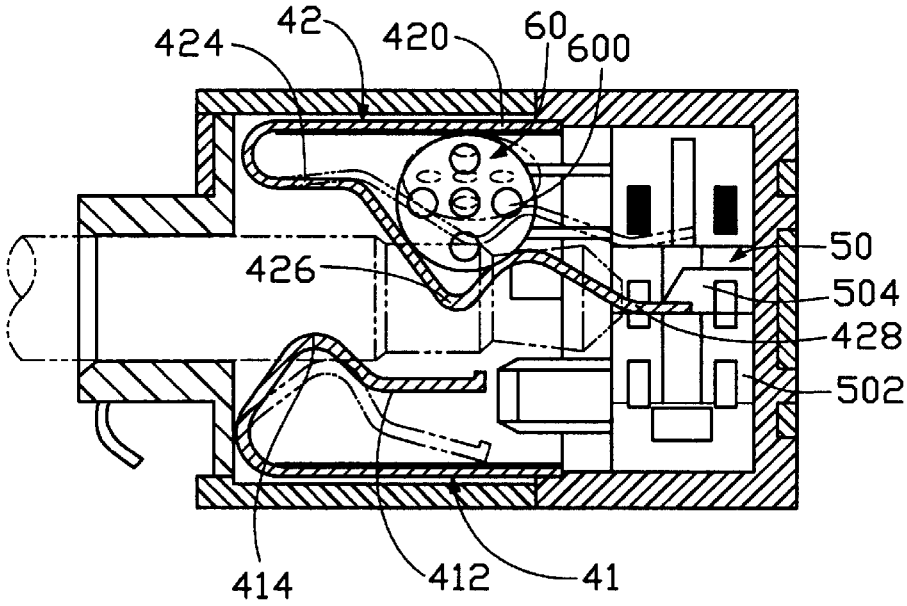
FIG. 3 is a cross-sectional view of FIG. 1 along line 3—3.

Referring to FIGS. 1 to 3, a socket connector 1 of the present invention includes an insulating housing 10, a shell 20, a plurality of terminals 30 and 31, resilient contacts 41 and 42, an insulating slide 50 and a resilient element 60.

The housing 10 includes a mating portion 11, a rear base 13, a connecting portion 12, and a rear cover 14 secured on the rear base 13. The mating portion 11 has a rectangular body 110 and a sleeve 112 protruding from a mating surface (not labeled) of the body 110 for insertion of a mating audio plug (shown as broken line in FIG. 3), and two protrusions 114. The connecting portion 12 includes securing blocks 120 and 122 securing the mating portion 11 therebetween. A post 124 is formed at a bottom surface of the block 120. The rear base 13 is assembled to the connecting portion 12 by a block 130 engaging to a slot (not labeled) defined in the connecting portion 12. The rear base 13 defines a plurality of terminal receiving channels 132 through a mounting surface of the housing 10 for the terminals 30 and 31 to extend therethrough. The rear base 13 further includes a post 134 extending from the mounting surface thereof.

The shell 20 includes a base portion 21 mounted at the mating surface of the rectangular body 110 of the mating portion 11. The base portion 21 defines a cantilevered clip 22 extending beyond the mating surface of the mating portion 11, and a grounding plate 24 extending beyond the mounting surface of the housing 10. The shell 20 further comprises two windows 26 engaged to the protrusions 114 of the rectangular body 110.

The terminals 30 and 31 are arranged in rows within terminal receiving channels 132 of the rear base 13 and include contact portions (not shown) received within the housing 10, portions (not labeled) extending out of the mounting surface of the housing 10.

The resilient contact 41 is secured to the connecting portion 12 and includes a tail portion 410 extending out of the mounting surface of the housing 10, and a contact portion 412 having a "U" shape in the connecting portion 12. The contact portion 412 forms a projection 414 protruding upward to the side wall of the housing 10 for contacting with the inserted plug. The resilient contact 42 is also secured to the side wall of the housing 10 opposite to the resilient contact 41 by a securing portion 420 engaged to the side wall of the housing 10. The resilient contact 42 also has a tail portion 422 extending out of the connecting portion 12, and a "U" shaped contact portion 424 in the connecting portion 12. The contact portion 424 has a free end 428 connected to the slide 50, and a projection 426 at a middle portion thereof protruding toward the side wall of the housing 10.

The slide 50 defines two electrical plates (not shown) and two parallel slots (not labeled) extending from a bottom surface thereof for receiving the two electrical plates therein. The housing 10 defines a slot 504 receiving the free end 428 of the resilient contact 42. After the slide 50 is assembled to the rear base 13, the electrical plates in the slots are disposed crossing the terminals 30*a*, 30*b*, 30*c*, 31*a*, 31*b* and 31*c*. When the slide 50 is in a different position, the plates contact with terminals 30*a*, 30*b*, 31*a*, 31*b*, or 30*b*, 30*c*, 31*b*, 31*c*, thereby switching electrical connection between some of the terminals.

The resilient element 60 is made of elastic insulating material with good resiliency. The resilient element 60 has a columnar shape in the present embodiment and defines a plurality of through holes 600 for increasing the resiliency property. The resilient element 60 is disposed between the projection 426 and the securing portion 420 of the resilient contact 42.

Referring to FIG. 3, when the audio plug is not inserted into the socket connector, the resilient element 60, disposed between the projection 42 and the side wall of the housing 10 maintains its normal shape because it does not endure pressing force from the plug, wherein the slide 50 contacts with the terminals 30*a*, 30*b*, 31*a* and 31*b*. After the plug is inserted into the connector, the contact portions 412 and 424 of the resilient contacts 41 and 42 are pushed to move toward the side wall of the housing 10, and the plug is engaged to the electrical plates of the slide 50. The free end 428 of the resilient contact 42 drives the slide 50 to slide to and contact with the terminals 30*b*, 31*c*, 31*b* and 31*c*. The resilient element 60 is compressed by an outward pushing force of the plug through the projection 426 of the resilient contact 42, i.e., the further movement of the contact portion 424 of the resilient contact 42 is stopped by the resilient element 60. Such a stopping action of the resilient element 60 prevents the resilient contact 42 from permanent deformation and provides the resilient contact 42 with sufficient contact force on the plug. After the plug is withdrawn from the connector, the resilient element 60 returns to its original shape, and the slide 50 returns to its original position thereby contacting with the terminals 30*a*, 30*b*, 31*a* and 31*b*.

Figure 4:
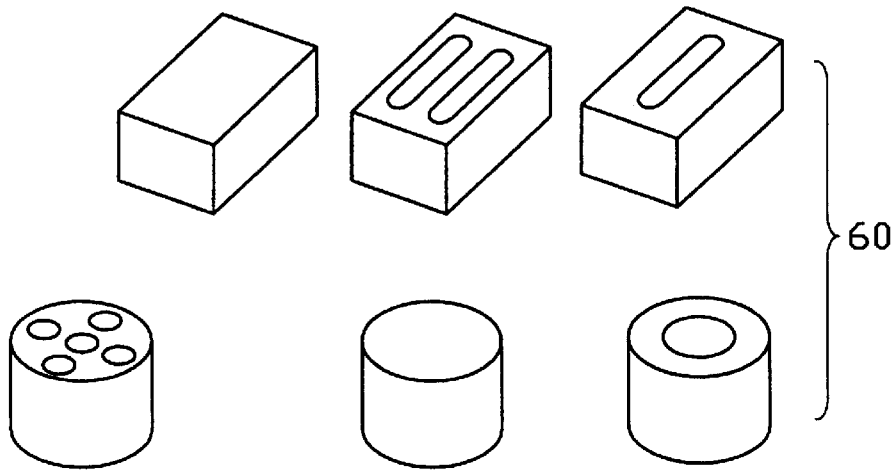
FIG. 4 illustrates various embodiments of a resilient element according to the present invention.

The resilient element 60 of the present invention could have other desired shapes as shown in FIG. 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket connector for insertion of a plug, comprising:

an insulating housing having a mating portion at a front thereof and a plurality of terminal receiving channels through a mounting surface thereof;

a plurality of terminals assembled to the housing and having contact portions disposed in the housing and mating portions extending out of the mounting surface of the housing through the terminal receiving channels;

at least one resilient contact having a securing portion secured within the housing and a contact portion for contacting with an inserted plug;

a slide assembled at a free end of the contact portion of the at least one resilient contact to movably connect with the terminals; and a resilient element disposed between a side wall of the housing and the contact portion of the at least one resilient contact, the resilient element exerting a force on the contact portion when the plug is inserted into the socket connector to push the contact portion toward the side wall of the housing thereby compressing the resilient element to be in a resilient state; wherein the housing includes a rear base, a connecting portion connecting the mating portion and the rear base, and a rear cover covering the rear base; wherein the resilient element has a columnar shape; wherein the resilient element defines a plurality of holes through two opposite surfaces thereof; wherein a shell is assembled to the mating portion of the housing, the shell including a base portion shielding both mating surface of the housing and a bottom surface of the mating portion.

2. The socket connector as claimed in claim 1, wherein the connecting portion of the housing forms a pair of posts at the mounting surface.

3. The socket connector as claimed in claim 1, wherein the rear base forms a pair of posts at the mounting surface.

4. The socket connector as claimed in claim 1, wherein the at least one resilient contact has a tail portion extending out of the mounting surface of the housing.

5. The socket connector as claimed in claim 1, wherein the base portion forms a clip inclinedly extending beyond the mating surface of the housing, and a grounding plate extending beyond the bottom surface of the mating portion.

* * * * *